United States Patent [19]

Frahme et al.

[11] 4,202,148

[45] May 13, 1980

[54] METHOD OF MAKING THICK-WALLED REFRACTORY FIBER MODULES AND THE PRODUCT FORMED THEREBY

[75] Inventors: Carl E. Frahme; Gary E. Wygant, both of Valencia, Calif.

[73] Assignee: Industrial Insulations, Inc., City of Industry, Calif.

[21] Appl. No.: 919,230

[22] Filed: Jun. 26, 1978

[51] Int. Cl.[2] ..... E04B 1/38; F27D 1/16

[52] U.S. Cl. ..... 52/592; 52/270; 52/506; 219/98; 432/248

[58] Field of Search ..... 52/592, 270, 506–513, 52/597, 267; 13/35; 65/2, 3 C, 4 R; 219/98; 428/99; 110/336; 432/247, 248; 228/140; 156/71

[56] References Cited

U.S. PATENT DOCUMENTS

| | | | |
|---|---|---|---|
| 1,335,909 | 4/1920 | Munroe | 52/592 |
| 3,456,914 | 7/1969 | Konrad et al. | 249/201 |
| 3,615,964 | 10/1971 | Malone | 156/62.6 |
| 3,706,870 | 12/1972 | Sauder et al. | 219/98 |
| 3,819,468 | 6/1974 | Sauder et al. | 52/270 X |
| 3,832,815 | 9/1974 | Balaz et al. | 52/509 X |
| 3,854,262 | 12/1974 | Brady | 52/506 X |
| 3,892,396 | 7/1975 | Monaghan | 52/506 X |
| 3,930,916 | 1/1976 | Shelley | 52/506 X |
| 3,940,244 | 2/1976 | Sauder et al. | 432/247 |
| 3,952,470 | 4/1976 | Byrd | 52/509 |
| 3,990,203 | 11/1976 | Greaves | 428/99 X |
| 3,993,237 | 11/1976 | Sauder et al. | 110/336 X |
| 4,001,996 | 1/1977 | Byrd | 52/509 |
| 4,120,641 | 10/1978 | Myles | 52/506 X |

*Primary Examiner*—J. Karl Bell

*Attorney, Agent, or Firm*—Sellers and Brace

[57] ABSTRACT

A method of making thick-walled heat insulation modules by vacuum accreting ceramic fibers from an aqueous solution onto a mold and the product provided thereby. The dimensionally stable generally rigid modules have a thickness of 3"–8" and a density of 10–12 lbs. per cubic foot and are readily subdivided and/or tailored if desired for overlapping intermeshing assembly to provide a continuous lining for a high temperature chamber withstanding operating temperatures between 1600° and 3,000° F.

16 Claims, 5 Drawing Figures

METHOD OF MAKING THICK-WALLED REFRACTORY FIBER MODULES AND THE PRODUCT FORMED THEREBY

This invention relates in general to the lining of high temperature chambers, and more particularly to a method of vacuum forming thick-walled modules of spun ceramic fibers which modules are essentially rigid and usable either directly as a high temperature chamber lining or readily subdivided and/or tailored to a desired configuration.

BACKGROUND OF THE INVENTION

The insulation of chambers of a wide variety of types and applications continue to present serious problems owing to the high temperatures involved and the severe operating conditions commonly present in such chambers. Traditionally and historically chambers of this type have been lined with various types of bricks, castables, or other dense refractories compounded to resist high temperatures. Such linings have many shortcomings and disadvantages well known to those skilled in this art including objectionably high weight, the need for high strength supporting structure, spalling, cracking and shattering, poor thermal shock properties, high cost of construction, maintenance and replacement, high heat storage, poor insulating ability, and others. In recent years lightweight non-rigid linings in a variety of types and construction and having certain superior properties have come into general usage. These linings are made of ceramic fiber material generally available in blanket form by depositing the fibers as formed on a moving conveyor as for example in accordance with the technique disclosed in the patent to Malone U.S. Pat. No. 3,615,964. The freshly formed fibers are deposited in layers along with a bonding agent to adhere the fibers together at points of cross-over. The resulting blanket has a thickness from a fraction of an inch up to 2', a density of 3–8 lbs. per cubic foot, and is readily flexed and wound into a roll of convenient handling size until ready for use. Some users subdivide these blankets into convenient handling size and attach one face directly to the furnace wall by ceramic cement mortar or the like. A lining of this thickness provides inadequate insulation unless applied over an existing lining and has an objectionably short service life and deteriorate prematurely under the harsh operating conditions normally prevailing in most high temperature chambers. Multiple layers of blanket can be attached to a furnace wall using appropriate mounting studs. Proper support has usually been a problem. Shrinkage also causes problems. Both result in tearing of the hot face blanket. Metallic studs are limited to 2250° F. exposure and ceramic studs have thermal shock problems.

Various designers familiar with these problems have made a variety of proposals for improved modes of utilizing ceramic blanket material to provide a lining of any desired thickness with the fiber layers lying generally perpendicular to the supporting wall structure. Typical proposals of this character are disclosed in Sauder U.S. Pat. No. 3,706,870; Sauder U.S. Pat. No. 3,819,468; Balaz U.S. Pat. No. 3,832,815; Brady U.S. Pat. No. 3,854,262; Monaghan U.S. Pat. No. 3,892,396; Shelley U.S. Pat. No. 3,930,916; Sauder U.S. Pat. No. 3,940,244; Byrd U.S. Pat. No. 3,952,470; Greaves U.S. Pat. No. 3,990,203; Sauder U.S. Pat. No. 3,993,237; and Byrd U.S. Pat. No. 4,001,996. Each of these proposals embodies means for holding strips of flexible ceramic blanket material assembled with adjacent faces of the strips in side-by-side relation and secured to a supporting frame or backing mountable against a furnace or chamber wall. In most instances, this mounting backing is designed to compress the strips transversely of their thickness in an effort to increase its density and to compensate for shrinkage at higher temperatures. It is readily apparent that these techniques incur objectionable labor, assembly, and material costs and provide a lining having an inferior density and heat insulating characteristics.

It has also been proposed to form heat insulating components by a vacuum forming process in which a perforated evacuated mold is suspended in an aqueous solution or slurry comprising primarily inorganic ceramic fibers and suitable binder agents. These components are thoroughly mixed in a water suspension by suitable means such as hydropulper or other mixer. This composition is deposited on the perforated face of the mold connected to a vacuum pump. This process as practiced prior to this invention provides a mat of fibers having a maximum depth of about two inches. When that depth is reached the resistance to further filtering and removal of water and deposition of fibers becomes too high for further deposition of fibers.

SUMMARY OF THE INVENTION

The foregoing and other shortcomings and disadvantages attending the use of refractory fibers have been overcome in a highly satisfactory manner by the present invention. The new and improved technique and product provided by this invention is bottomed on the discovery that homogeneous fiber modules of high quality and uniformity having a wall thickness several times greater than that heretofore producible using the vacuum filtering technique provided fibers of proper length are utilized. It is important that the slurry in which the mold is suspended during the vacuum forming operation contain essentially longer fibers, such as refractory fibers known as spun fibers or their equivalent, since it has been discovered that this is a crucial requirement for the production of thick-walled components having a thickness of 3–8".

For example, it has been discovered that refractory fibers produced by the conventional steamblown method and having assorted lengths few of which are as long as one inch are unsatisfactory and unsuitable for forming modules of thicknesses greater than about two inches using the vacuum filter process. However, refractory fibers produced centrifugally from a spinning rotor and known commercially as spun fibers are eminently satisfactory. Spun fibers are substantially longer than steam-blown fibers and have a typical length of three to six inches. It has been discovered that these long fibers are deposited essentially and basically in criss-crossing layers wherein each fiber has a multiplicity of points of criss-cross contact with adjacent fibers to which they are bonded. This multiplicity of bonding contacts with other fibers is believed to maintain the fibers in outstretched condition such that portions between bonding points do not sag to clog the gap. An excellent module having any desired thickness greater than 3 inches and including in particular thicknesses between 3 and 8 inches is obtained using long fibers. The dimensionally stable generally rigid, slightly resilient, non-flexing module can be used as a wall liner in its original molded shape, or it can be readily subdivided into plaques, bricks, blocks and the like units and assembled against a wall or the like to be protected. The entire module or the sub-units into which it is divided are likewise readily notched and otherwise tailored to internest or interlock with one another to strengthen the lining and prevent displacement of the units relative to one another as well as to avoid gaps through which heat can pass to the supporting outer wall.

Accordingly, it is a primary object of this invention to provide an improved method of vacuum-forming a thick-walled heat-insulating module from an aqueous slurry of long refractory fibers and suitable binder material.

Another object of the invention is the provision of an improved and unique essentially rigid liner of lightweight refractory fiber material wherein the fiber layers are generally parallel to the opposed faces thereof.

Another object of the invention is the provision of a lightweight refractory unit which is dimensionally stable and non-flexible and formed of refractory fibers deposited generally in superimposed layers bonded together and useful in providing an insulating liner having a thickness of three inches or more for the walls of high temperature chambers.

Another object of the invention is the provision of a generally rigid lightweight liner unit for high temperature chambers shaped along the lateral and transverse edges thereof for internesting, interlocking assembly.

These and other more specific objects will appear upon reading the following specification and claims and upon considering in connection therewith the attached drawing to which they relate.

Referring now to the drawing in which a preferred embodiment of the invention is illustrated:

Figure 1:
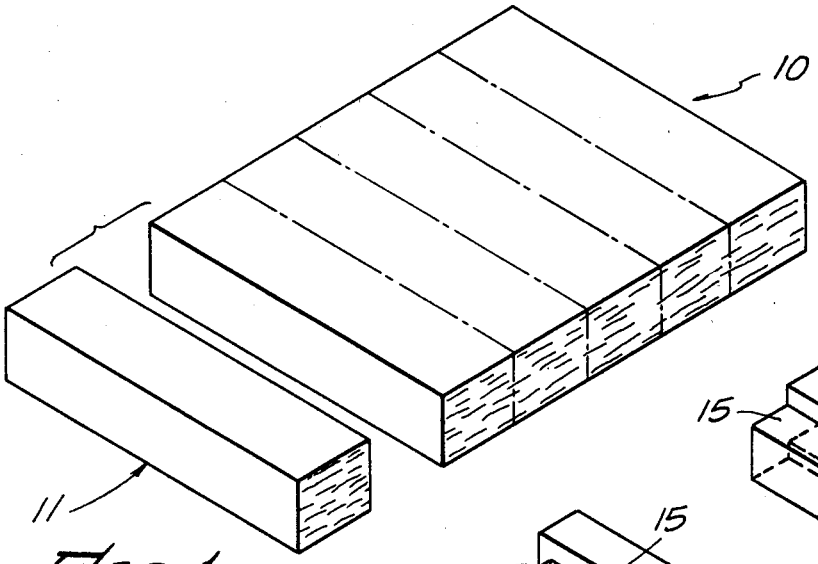
FIG. 1 is an exploded perspective view of the invention refractory fiber module after removal from the vacuum mold assembly and after its uneven exterior surfaces have been removed and indicating one manner in which the module may be divided into liner elements.

This invention consists of the construction or formation of improved heat insulating modules from compositions comprising primarily inorganic fibers bonded together in layers by binder material which are essentially rigid and non-flexible exhibiting highly effective physical strength and high thermal insulating properties. The invention includes a method of forming the modules by vacuum filtering technique to a wall thickness of three to eight inches. Suitable inorganic refractory fibers for the practice of the invention comprise common manufactured fibers as opposed to natural mineral fibers such as asbestos and possessing effective resistance and integrity at temperatures of at least 1600° or more. Suitable manufactured inorganic refractory fibers are well known in the literature such as those identified in the patent to Konrad et al U.S. Pat. No. 3,456,914. Such fibers typically comprise fibers formed from melts of compositions generally predominantly of silicates of calcium, aluminum and the like di- or tri-valent metals, and include the familar rock wools, mineral or slag wools, glass wools or fibers of high temperature melting conditions, ceramic fibers, and in particular the highly refractory fibers consisting wholly of alumina and silica or primarily of alumina and silica with added oxides such as titania or zirconia or borosilicate fibers, or essentially pure silica fibers, or essentially pure alumina fibers, etc. and assorted apt mixture of any of the foregoing.

Suitable binders for holding these refractory fibers bonded together at points of cross-over are likewise well known to those skilled in this art such as those disclosed in the aforementioned Konrad et al patent. A particularly satisfactory inorganic binder employed in this invention comprises colloidal silica and an organic binder comprising cationic starch. Set forth in the following table are four specific examples of slurry compositions each of which has been found to provide highly satisfactory modules having a thickness of three to eight inches depending upon the length of time the mold member is held evacuated while submerged in a slurry of one of these specific compositions.

| Component | Specific Examples | | | |
|---|---|---|---|---|
| | 1 | 2 | 3 | 4 |
| Long refractory alumina-silica fiber | 86.4% | 77.8% | 60.7% | — |
| Aluminum oxide fiber | — | 8.6% | 25.7% | 86.4% |
| Colloidal silica binder | 8.9% | 8.9% | 8.9% | 8.9% |
| Cationic starch binder | 4.7% | 4.7% | 4.7% | 4.7% |

The amount of each ingredient in the several examples are set forth in percentage by weight omitting the water in which these ingredients are mixed. In each instance the listed ingredients are mixed with 1500 gallons of water. The size of the batch made may be varied to suit the requirements of the manufacturing process.

A suitable long refractory fiber comprising the total or major fiber constituent of Examples 1, 2 and 3 comprises alumina-silica consisting essentially of 47% alumina and 53% silica. The aluminum oxide fiber is a particularly high temperature refractory material which is used in greater proportions for higher temperature applications. A suitable source of commercial supply for aluminum oxide fiber is Imperial Chemical Industries Ltd., England. A suitable inorganic binder comprises colloidal silica obtainable from Nalco Chemical Company as Spec. No. 1140. A suitable cationic starch is obtainable from American Key Products of New York City.

Example No. 1 provides modules satisfactory in applications wherein the chamber temperature does not exceed 2400° F. Example No. 2 contains some aluminum oxide fiber or an equivalent thereof and provides liner units useful under temperature conditions up to 2600° F. Example No. 3 contains a higher percentage of the high temperature refractory fiber and is satisfactory for temperatures as high as 2800° F. The product provided by the fourth example utilizes essentially only the high temperature refractory, such as aluminum oxide fiber.

It will be understood that the weight percentages set forth in each of the four examples comprises the preferred amount in each instance. However, it is to be recognized that these percentages may be varied in both directions from the preferred value listed and that relative proportions of the low and high temperature fibers may be varied to provide a product to withstand a particular temperature. The listed preferred values provide a module having a density of 10 to 12 lbs. per cubic foot. The inorganic binder may vary between 6 and 12% and the organic binder may vary between 3 and 7%.

Figure 2:
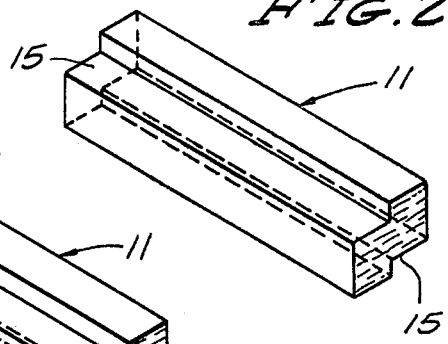
FIG. 2 is a perspective view on an enlarged scale showing one of the module elements rabbeted along one diagonally related pair of longitudinal corners.
Figure 3:
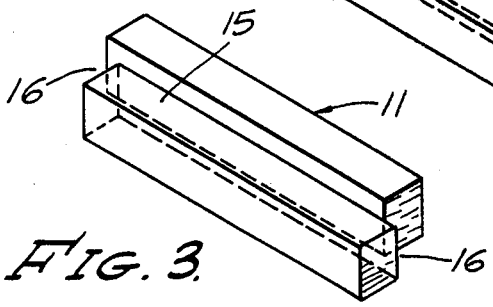
FIG. 3 is a view similar to FIG. 1 showing the module element of FIG. 2 additionally rabbeted along a diagonally related pair of end corners.

Referring to the drawing and more particularly to FIGS. 1, 2 and 3, there is shown a homogeneous fiber module 10 after being removed from a conventional type vacuum mold assembly. The perimeter edges and the face remote from the mold assembly have been trimmed away and a module element 11 has been detached from the left hand end by a band saw or the like. Module 10, typically measuring two feet by three feet and six inches thick is formed in accordance with well known vacuum forming practice using a hollow mold submerged in a tank of dilute aqueous slurry containing a composition of the formulation disclosed hereinabove. The mold assembly has a perforated surface of the size of the desired module overlaid on its exterior with a fine wire fabric and the interior of the mold is connected to a source of high vacuum in accordance with customary practice. The slurry is maintained in continuous circulation at a predetermined level by connection to an adequate supply of makeup slurry.

The vacuum acting on the mold assembly deposits the fibers generally in layers in random array as the thickness of the deposit gradually increases by accretion. Water present in the slurry is withdrawn into the mold assembly and to a place of collection. Owing to the fact that the majority of the fibers are two, three and up to six or more inches in length and in cross-over contact with the multitude of underlying fibers coated with binder material, the fibers remain outstretched and do not sag between points of cross-over with other fibers. Accordingly, the deposited fibers do not interfere with the escape into the mold assembly of the water constituent with the result that modules having a wall thickness up to eight inches are readily achieved. The wall thickness achieved in prior practice employ fiber slurries wherein the great majority of the fibers have lengths of one inch or less. It is found that the pressure drop across deposits of these short fibers onto a mold is so high that the maximum practical thickness of the resulting module is about two inches.

Module 10 may be subdivided into smaller components in numerous ways as, for example, by separating it into thinner layers of a suitable thickness for application as a veneer to the interior of any high temperature chamber. Such veneering applications are typically employed to increase the thickness of previously applied heat insulation of the same but usually of a different character. The large plaques are customarily secured in place by a high temperature mastic or mortar of a type well known in this art.

Owing however to the thickness to which modules of this invention are easily and efficiently made, the large modules 10 are subdivided into module elements 11 having the dimension in the plane of the fiber layers corresponding to the thickness of the chamber lining to be formed therefrom. Since the lateral face to be exposed to the chamber temperature typically shrinks slightly, a diagonally related pair of lateral corners are rabbeted as indicated at 15. As here shown by way of example the rabbets have a width in the direction of the fiber layers of one half the width of the module and a depth substantially less than that width. FIG. 2 shows the module with only the lateral corners rabbeted whereas FIG. 3 additionally shows a pair of diagonally related end corners formed with vertical rabbets 16 extending at right angles to the horizontal rabbets 15. The depth of rabbets 16 lengthwise of the module is somewhat exaggerated in FIG. 3 in the interest of clarity of illustration.

Figure 4:
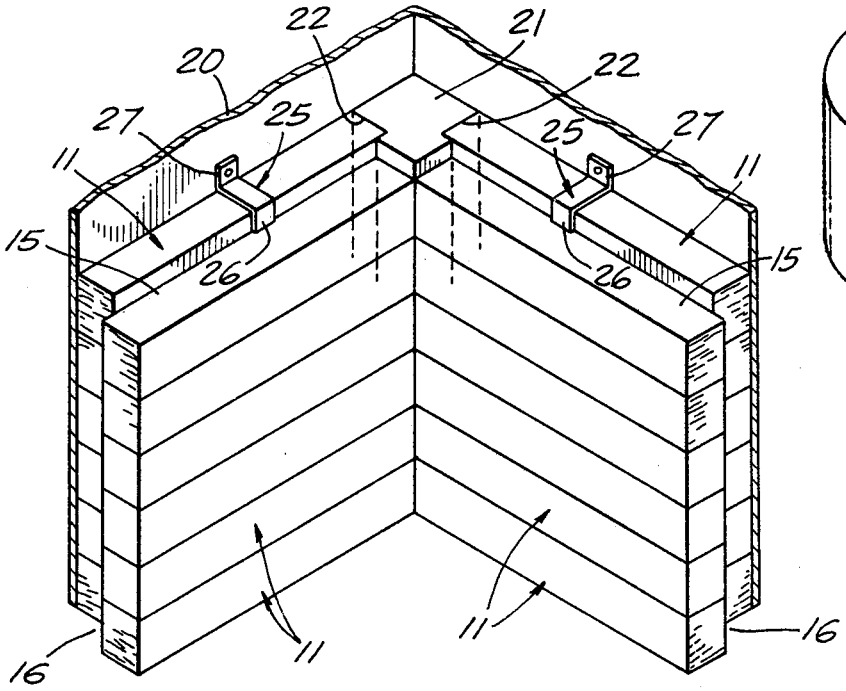
FIG. 4 is a perspective view of an interior corner of a furnace chamber showing the manner in which the module elements are assembled in internesting relation to provide a protective lining for the entire chamber.

FIG. 4 shows modules 11 being assembled interiorly of a conventional high temperature chamber wall 20. The corner of this chamber may be provided with a fiber module 21 tailored lengthwise thereof with rabbets 22 sized to mate snugly with the projecting ends of modules 11. The corner module 21 usually has a length corresponding to that of modules 11 or adequate to bridge the ends of several of the latter modules. Modules 11 are stacked one on top of the other and are suitably anchored in place as by stainless steel clips 25 having one end 26 extending into a rabbet 15 and its other end 27 extending in the opposite direction and secured to wall 20 by any suitable fastener means.

Figure 5:
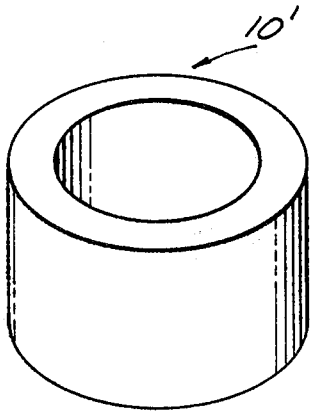
FIG. 5 is a perspective view of a tubular refractory fiber module made in accordance with the principles of this invention.

FIG. 5 shows a refractory fiber module 10' wherein the fibers have been accreted onto the exterior of a tubular vacuum mold assembly to provide a thick-walled tubular product. Such modules whether tubular or some other configuration are readily made to the same thickness as planar modules and may be tailored in a similar way, such as by rabbeting one or both ends to internest with the rabbeted end of another module. Such modules have many applications as liners for crucible furnaces, laboratory furnaces, flues and the like.

While the particular method of making thick-walled refractory fiber modules and the product formed thereby herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. A lightweight dimensionally-stable, homogeneous, generally non-flexible refractory liner element for lining the wall of a high temperature chamber consisting of:

a multiplicity of layers of spun refractory fibers typically having a length of 3 to 6 inches accreted by vacuum deposition to a thickness of 3 to 8 inches from an aqueous slurry of sald fibers and held bonded together by binder material; and at least one corner of said element being deeply rabbeted ship-lap fashion from end-to-end and adapted to mate complementally with the similarly rabbeted corner of another of said elements to form a lining for a high temperature chamber with the planes of said fiber layers lying in planes generally normal to the chamber wall.

2. A homogeneous refractory liner element as defined in claim 1 characterized in that diagonally related corners thereof are similarly rabbeted.

3. A homogeneous refractory liner element as defined in claim 1 characterized in that the diagonally opposed transverse end corners of said element are similarly rabbeted.

4. A homogeneous refractory liner element as defined in claim 1 characterized in that said element has a density ranging between about 10 to 12 pounds per cubic foot.

5. A homogeneous refractory liner element as defined in claim 2 characterized in that said rabbets are rectangular in cross-section with the longer dimension thereof lying parallel to one another.

6. A substantially rigid high temperature refractory liner element consisting of:

a multiplicity of vacuum accreted layers of spun ceramic fibers bonded together in a single homogeneous mass having a density of the order of 10–12 pounds per cubic foot and forming a rectangular parallelopiped modified after being vacuum accreted by having one diagonally related pair of its longer corners and one diagonally related pair of its end corners rabbeted from end-to-end and transversely thereof whereby a plurality of said lining elements are adapted to be internested ship-lap fashion to form a continuous gapless refractory furnace chamber lining.

7. A homogeneous furnace liner element as defined in claim 6 characterized in that said rabbets are rectangular in cross-section with the longer side thereof lying parallel to one another.

8. A lightweight generally non-flexible homogeneous liner element for lining the wall of a high temperature chamber consisting of:

a multiplicity of layers of refractory fibers accreted by vacuum deposition to a thickness of at least three inches from an aqueous slurry of said fibers and held bonded together by binder material, said liner element having a density of 10–12 pounds per cubic foot and the major quantity of said fibers having a length of at least two inches.

9. That method of making blocks adapted for internesting assembly to form a refractory lining for a high temperature to withstand temperatures ranging between 2400° and 3000° F. chamber which comprises:

vacuum depositing a multiplicity of layers of ceramic fibers from an aqueous solution of said fibers and a binder material therefor to form a slab of inter-bonded fibers to a thickness ranging between 3 and 8 inches and having a density of about 10 to 12 pounds per cubic foot, sub-dividing said slab into a plurality of rectangular parallelopiped blocks, and rabbeting one diagonally related pair of longer corners and one diagonally related pair of end corners of said blocks whereby a plurality of said blocks are adapted to be internested to form a lining for a high temperature chamber.

10. That method defined in claim 9 characterized in the step of utilizing ceramic fibers predominately having a length of at least three inches.

11. That method defined in claim 9 characterized in the step of using spun ceramic fibers.

12. A lightweight homogeneous substantially rigid refractory element for use as an internal lining for a high temperature chamber subject to temperatures of 1600° F. to 3000° F., said element consisting of a multiplicity of layers of inter-bonded spun ceramic fibers vacuum deposited from an aqueous suspension thereof containing a binder for said fibers at points of crossover, said element having a density of the order of 10–12 pounds per cubic foot and a thickness normal to the plane of said fiber layers of not less than 3 inches.

13. A high temperature refractory element as defined in claim 12 characterized in that said element is vacuum formed in a slab sized for sub-division into a plurality of elongated elements each having a width at least as great as the thickness thereof.

14. A high temperature refractory element as defined in claim 12 characterized in that said element is tubular.

15. A high temperature refractory element as defined in claim 12 characterized in that at least one end thereof is provided with a continuous rabbet.

16. A high temperature refractory element as defined in claim 14 characterized in that at least one end thereof is provided with a continuous rabbet.

* * * * *